US010891893B2

(12) United States Patent
Nadershahi

(10) Patent No.: US 10,891,893 B2
(45) Date of Patent: Jan. 12, 2021

(54) CURRENT CONTROLLER FOR OUTPUT STAGE OF LED DRIVER CIRCUITRY

(71) Applicant: PLANAR SYSTEMS, INC., Beaverton, OR (US)

(72) Inventor: Shahnad Nadershahi, Beaverton, OR (US)

(73) Assignee: Planar Systems, Inc., Beaverton, OR (US)

( * ) Notice: Subject to any disclaimer, the term of this patent is extended or adjusted under 35 U.S.C. 154(b) by 0 days.

(21) Appl. No.: 16/642,893

(22) PCT Filed: Aug. 30, 2018

(86) PCT No.: PCT/US2018/048940

§ 371 (c)(1),
(2) Date: Feb. 27, 2020

(87) PCT Pub. No.: WO2019/046633

PCT Pub. Date: Mar. 7, 2019

(65) Prior Publication Data

US 2020/0349881 A1 Nov. 5, 2020

Related U.S. Application Data

(60) Provisional application No. 62/552,316, filed on Aug. 30, 2017.

(51) Int. Cl.
*G09G 3/32* (2016.01)

(52) U.S. Cl.
CPC ..... *G09G 3/32* (2013.01); *G09G 2320/0233* (2013.01); *G09G 2320/064* (2013.01)

(58) Field of Classification Search
None
See application file for complete search history.

(56) References Cited

U.S. PATENT DOCUMENTS 10,096,284 B2 * 10/2018 Vahid Far ..... G09G 3/3275
10,455,653 B1 * 10/2019 Watanabe ..... G09G 3/32
(Continued)

OTHER PUBLICATIONS

International Search Report and Written Opinion for International Application No. PCT/US2018/048940, dated Dec. 26, 2018, 7 pages.

*Primary Examiner* — Chad M Dicke
(74) *Attorney, Agent, or Firm* — Stoel Rives LLP

(57) ABSTRACT

A current controller for an output stage of light emitting diode (LED) driver circuitry includes a current source establishing a nominal amount of current available for each member of the set of channels. The nominal amount of current is based on, e.g., a desired brightness level. Pulse width modulation (PWM) circuitry is electrically coupled to the current source and is configured to control durations in which adjusted amounts of current are applied to corresponding members the set of LEDs. Compensation circuitry is electrically coupled to the current source and the PWM circuitry. The compensation circuitry includes a set of switching elements to adjust, for each corresponding member of the set of LEDs, the nominal amount of current and thereby provide to the PWM circuitry the adjusted amounts of current based on feedback representing one or both load impedance variations and parasitic conditions (LIVPC) and process, voltage and temperature (PVT) conditions.

10 Claims, 6 Drawing Sheets

(56) References Cited

U.S. PATENT DOCUMENTS

2002/0101172 A1* 8/2002 Bu ..... G09G 3/3233 315/169.3
2002/0130786 A1* 9/2002 Weindorf ..... G02F 1/133603 340/815.45
2002/0167471 A1* 11/2002 Everitt ..... G09G 3/3216 345/76
2003/0052904 A1* 3/2003 Gu ..... G09G 3/2014 345/691
2003/0230991 A1* 12/2003 Muthu ..... H05B 45/28 315/307
2004/0233125 A1* 11/2004 Tanghe ..... G06F 3/1446 345/1.3
2006/0139251 A1* 6/2006 Morosawa ..... G09G 3/3283 345/76
2006/0139264 A1* 6/2006 Choi ..... G09G 3/3283 345/76
2008/0238327 A1* 10/2008 Cho ..... G09G 3/3241 315/169.3
2009/0212716 A1 8/2009 Chen et al.
2010/0110059 A1* 5/2010 Kang ..... G09G 3/342 345/211
2010/0177127 A1* 7/2010 Akiyama ..... G09G 3/36 345/690
2011/0012521 A1* 1/2011 Byun ..... H05B 45/46 315/186
2011/0241572 A1 10/2011 Zhang et al.
2013/0076250 A1 3/2013 Logiudice

* cited by examiner

CURRENT CONTROLLER FOR OUTPUT STAGE OF LED DRIVER CIRCUITRY

RELATED APPLICATION

This application is a National Stage of International Application No. PCT/US2018/048940, filed Aug. 30, 2018, which claims priority benefit of U.S. Provisional Patent Application No. 62/552,316, filed Aug. 30, 2017, which are hereby incorporated by reference.

TECHNICAL FIELD

The field of the present disclosure relates generally to techniques for driving light emitting diode (LED) display panels and, more particularly, to adjusting an amount of current applied to each LEDs.

BACKGROUND INFORMATION

FIG. 1 shows a simplified LED display 100 including an LED array 110 arranged for form an m×n display matrix. Switching circuitry 112, such as transistors of an FPGA, establishes n scanlines (rows) in which n equals three because there are three switches (SW[1]-SW[3]) in the present example. Likewise, an analog output stage 120 defines m channels (columns) in which m equals three because there are three current sources to provide current to three channels (CH[1]-CH[3]). The current sources are shown as single-channel drivers, but other embodiments may include multi-channel drivers.

To illuminate an LED located at an intersection of a column and a row, a current source for the channel supplies current that flows through the LED once a switch (SW) for the scanline is actuated. For time-multiplexing display of visual content, there may be zero to m channels supplied with currents while one scan line is refreshed at a time. For a given scan, current is controlled so as to vary an LED's brightness. In general, a greater amount of current delivered to the LED produces a higher brightness. To deliver the current for precise durations (e.g., when forming color combinations with other LEDs) perceived as dimming, pulse width modulation (PWM) dimming is employed to rapidly switch on and off of the current.

One of the performance characteristics of an LED is the time it takes (latency) for it to illuminate after its corresponding scan switch is actuated. Deviations from the expected or nominal latency are caused by various components in an LED display and associated circuitry introducing load variations between LED devices due to scale and density of the components. The load variations are, for example, attributable to variations in process, voltage, and temperature (PVT) as well as load impedance variations and parasitic conditions to which the LED may be subjected during its operation. For example, impedance differences arise from differences in traces, vias, cross connections, noise, and other features introducing parasitic capacitance prevalent on printed circuit boards (PCBs). More specifically, from the perspective of different output terminals of an output stage, each LED is subjected to a different amount of capacitance (parasitic conditions). Likewise, different scanline selections establish different capacitances on the same channel. Such parasitic capacitances are modeled as capacitors shown in FIG. 1 as $C_W$ (capacitive impedance of LED driver output including packaging contribution); $C_{trace}$ (capacitive impedance of PCB including vias and trace bends); $C_L$ (capacitive impedance across an LED component); and $C_S$ (capacitive impedance of switch element, e.g., implemented in FPGA or control logic).

Load variations have made it challenging to predictably drive LEDs at precise currents because, in additional to supplying current to an LED, its current source will also charge parasitic capacitance electrically coupled to the LED. Accordingly, fluctuations in current that is actually applied to LEDs introduce noise, visual artifacts, and sometimes compromise core device functionality. For example, fluctuation in current causes undesirable variations in LED brightness.

SUMMARY OF THE DISCLOSURE

The present inventor has recognized a need for improved techniques for adjusting constant current sources so as to account for PVT considerations, PCB parasitic effects, and other anomalies impacting current and generally referred to load impedance variation and parasitic conditions (LIVPCs). This disclosure is, thus, directed to methods, devices, and systems for compensating for such effects and thereby provides for more consistent brightness of LEDs even for visual content displayed at low levels of brightness.

Current compensation circuitry is employed in an analog output circuit (or more generally, an output circuit, structure, or stage of LED driver circuitry) so as to provide fine adjustments in current that is actually applied to LED(s). Such adjustments may be statically scaled by feedback from a calibration routine or dynamically scaled using feedback obtained from high-speed sensing circuitry. For example, to compensate for changes in load, current supplied to each pixel formed by one or more LEDs is dynamically supplemented. Thus, this disclosure optimizes the amount of current based on feedback in the form of one or both of prior calibration data and dynamically assessed load variations.

According to some embodiments, a compensation circuit includes a controller generating a set of digital control signals actuating switches that provide, for each LED, a controllable amount of supplemental current applied to an LED. The amount is in proportion to a primary (i.e., constant) current and is configured to compensate for variations in PVT conditions as well as changes due to impedance variations and parasitic, thereby improving transient response. In some embodiments, an optional monitor circuit is configured to track the operation of the LED and, in response, generate a control signal representing the variations in PVT as well as load impedance variations and parasitic conditions to which the LED may be subjected.

Because designing compensation networks can be complicated, LED driver circuitry having integrated feedback or other control topologies helps minimize design time and complexity of current compensation at the expense of design flexibility. Accordingly, in describing compensation functions capable of being performed by an output stage of LED driver circuitry presenting visual content, the disclosure provides for reduced design complexity and layout area penalties compared to those of conventional output design approaches. Thus, techniques described in this the disclosure provide an improved output circuit having reduced design complexity and layout area.

According to one embodiment, a current controller for an output stage of light emitting diode (LED) driver circuitry defining a set of channels through which electrical current is controllably deliverable to a set of LEDs along an actuatable scanline, comprises a current source to establish a nominal amount of current available for each member of the set of channels, the nominal amount of current being based on a desired brightness level; pulse width modulation (PWM) circuitry electrically coupled to the current source and configured to control durations in which adjusted amounts of current are applied to corresponding members the set of LEDs; and compensation circuitry electrically coupled to the current source and the PWM circuitry, the compensation circuitry including a set of switching elements to adjust, for each corresponding member of the set of LEDs, the nominal amount of current and thereby provide to the PWM circuitry the adjusted amounts of current based on feedback representing one or both load impedance variations and parasitic conditions (LIVPC) and process, voltage and temperature (PVT) conditions.

In another embodiment, the compensation circuitry comprises a compensation parameter storage device to store, for each LED, values representing adjustment amounts (e.g., representing a range between positive and negative amounts of current) by which to adjust the nominal amount of current. In yet another embodiment, each value of the values includes multiple bits, each one of the multiple bits indicating a state of a different member of the set of switching elements.

In still another embodiment, the compensation circuitry comprises a compensation parameter controller to generate, based on a value stored in the compensation parameter storage device, a set of digital signals corresponding to the set of switching elements.

Additional aspects and advantages will be apparent from the following detailed description of embodiments, which proceeds with reference to the accompanying drawings.

DETAILED DESCRIPTION OF EMBODIMENTS

Initially, skilled persons will appreciate that LED driver circuitry may include, among other things, a PWM controller, a system controller, scanline switch circuitry (e.g., FPGA), clock source(s), and an (analog or mixed-signal) output stage. Depending on the implementation, two or more of the aforementioned components may be included in a common integrated circuit (IC), which is generally referred to an LED driver IC. For example, some LED driver ICs include a PWM controller, a clock source, and an output stage, in which case a system controller and FPGA are available as separate ICs to form a system that controls an array of LEDs. For conciseness, however, this disclosure focuses more on improvements to the output stage of LED driver circuitry. Additional details on other components of LED driver circuitry are available in other patent documents, including those previously filed by Planar Systems, Inc.

Figure 2:
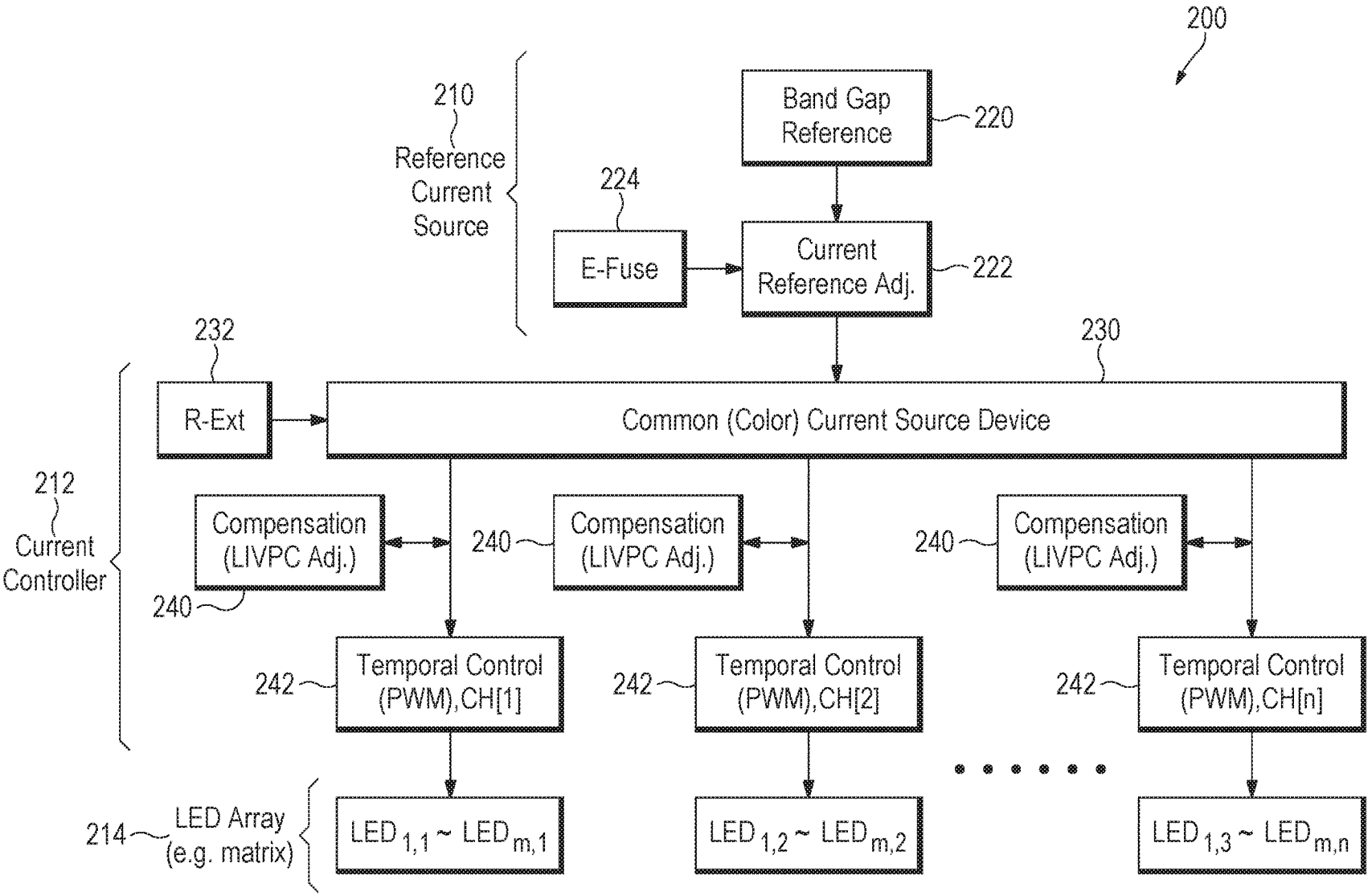
FIG. 2 is a high-level block diagram of an output circuit including LED driver circuitry, according to one embodiment.

FIG. 2 shows, for an example color (e.g., red, green, or blue), an output stage 200 including a reference current source 210, a current controller 212, and an LED array 214 subject to LIVPCs. As an aside, LIVPCs also may refer to PVT effects, but the two are sometimes referred to as distinct features.

Figure 1:
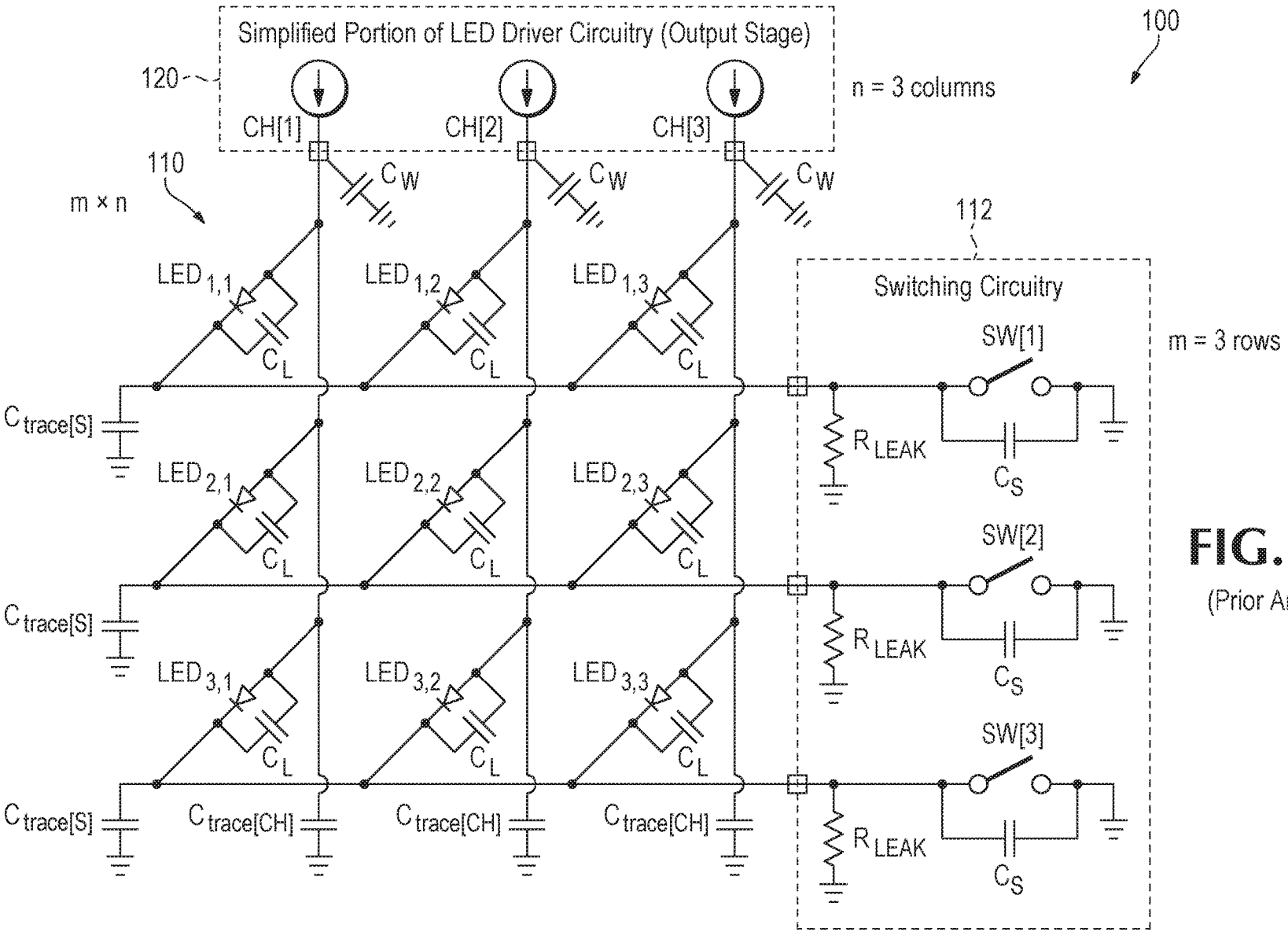
FIG. 1 (Prior Art)
FIG. 1 is a high-level electrical schematic diagram showing an LED display, according to the prior art.

Reference current source 210 includes a band gap voltage reference 220 used to bias transistor devices establishing a PVT-compensated current reference 222 that is adjustable by an e-fuse 224 compensating for IC-to-IC variations. For conciseness, additional details of reference current source 210 need not be described, and skilled persons will appreciate reference current sources have numerous design-specific implementations using p-type metal-oxide-semiconductor (PMOS) and n-type metal-oxide semiconductor (NMOS) transistor devices formed using a complementary metal-oxide-semiconductor (CMOS) fabrication process. This disclosure, however, is not limited to such transistor devices or a particular fabrication process. Likewise, LEDs arranged in manners other than those in FIG. 1 (common cathode, common anode, or another type of LED array) would have similar impedance and load parasitic forms and can similarly benefit from embodiments described in the present disclosure.

Current controller 212 includes a common current source device 230 establishing an available amount of current that is common to all n channels (e.g., all 16 red-color channels). According to one example, common current source device 230 applies to all LEDs that are red in color (i.e., the so-called red channels) a predefined current that amounts to some portion of a maximum amount of current available from reference current source 210. For example, common current source device 230 may include current mirror(s), digital-to-analog converter(s) (DACs), or other circuitry that, based on an external resistor 232 or other adjustment device, provides a color-specific constant amount of current. In other words, constant current sources have various implementations appreciated by skilled persons as establishing a nominal amount of current in which the amount is gain-adjustable to accommodate changes in a system-wide desired level of brightness. For example, for LEDs that are red in color, a nominal amount of current for a desired brightness level might be 20 milliamps (mA). The nominal amount of current is intended to be consistent for each LED in a channel, notwithstanding each LED having different LIVPCs.

To compensate for the different LIVPCs, current controller 212 includes for each channel, compensation circuity 240 to adjust (e.g., source or sink), by a controllable amount, the nominal amount of current that would otherwise be available for PWM circuitry 242 of each channel. The actual amount of current that is then made available for PWM circuitry 242 in a channel (and thus the corresponding PWM-controlled LED on an actuated scanline) is referred to as an adjusted amount of current (or simply, adjusted current).

In some embodiments, the controllable amount of compensation current (or simply, compensation current) controllably adjusts the nominal amount of current (or simply, nominal current) by about ±7.75% of a maximum amount (e.g., proportional to current at max brightness) or the nominal amount (e.g., proportional to current at the selected brightness) so as to counteract LIVPCs, especially in low-brightness settings. For example, if an LED is subjected to relatively higher amounts of parasitic capacitance due to, e.g., its trace lengths being longer than those of LEDs, then the compensation current supplements the nominal current that would otherwise be applied to the LED during PWM modulation. The compensation current thereby reduces latency by more quickly charging the aforementioned parasitics.

Adjustments to the nominal current are made according to one more of the following operating modes: PVT adjustment; LIVPC adjustment; and feedback adjustment. Of the three modes of operation, the latter two are dynamic and the first one (PVT adjustment) is applied during the power up and need not be dynamically applied. The modes are described later in connection with FIG. 6.

Figure 3:
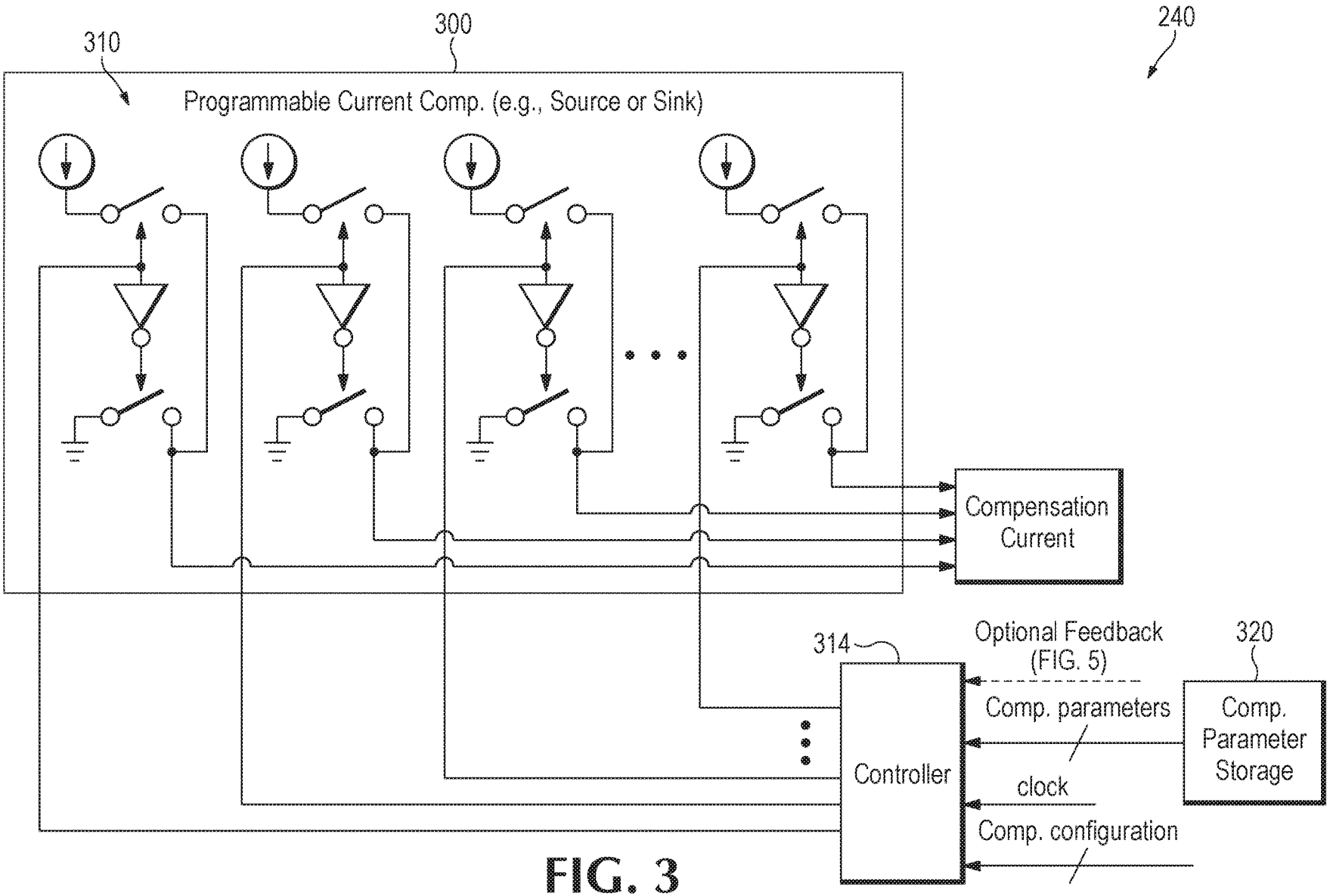
FIG. 3 is a block diagram showing, in more detail, compensation circuitry of the output circuitry of FIG. 2, according to one embodiment.

FIG. 3 shows an example of compensation circuity 240 in more detail. A programmable current compensator 300 includes a set of switching elements 310 actuated based on digital control signals from a compensation parameter controller (e.g., digital logic device) 314. Each switching element 310 may include a single transistor, multiple transistors, or other types of circuitry to configure programmable current compensator 300 to act as a current source, a current sink, or another type of device that suppresses or enhances the nominal amount of current available for an LED. Skilled persons will appreciate that programmable current compensator 300 having an array of switching elements is merely an example, and that programmable current compensator 300 could be implemented by other means and methods not illustrated herein.

In the example of FIG. 3, each switching element is actuated to either supply to or sink from the nominal amount of current an incremental amount of compensation current. If half of the switching elements are actuated to source supplemental current, and the other half are not actuated, then there is no change to the nominal current. If all of the switching elements are actuated to source current, then the nominal current is increased by about 7.75%. And if none of the switching elements are actuated to source current, then the nominal current is decreased by about 7.75%. In other words, provided a set of 32 parallel switching elements 310 available in programmable current compensator 300, a first subset of 16 may potentially counteract a second subset of 16 because each output node of switching elements is connected to a corresponding node in a channel, and the corresponding node provides an incremental portion of the nominal current. The aforementioned connections adjust those incremental portions through analog circuitry such that the overall net contribution from programmable current compensator 300 amounts to the compensation current provided according to a specified percentage range (e.g., ±7.75%).

Controller 314 produces digital control signals based on a compensation parameter (see e.g., FIG. 6), optional dynamic feedback, and an optional configuration setting that identifies whether the dynamic feedback or the compensation parameters are to be used in generating digital control signals. Compensation parameters are stored in a storage memory (e.g., SRAM) 320 or other machine-readable device. The compensation parameters are extracted from storage per each specific LED and are for carrying out dynamic adjustments of the nominal amount of current, as described previously.

Figure 4:
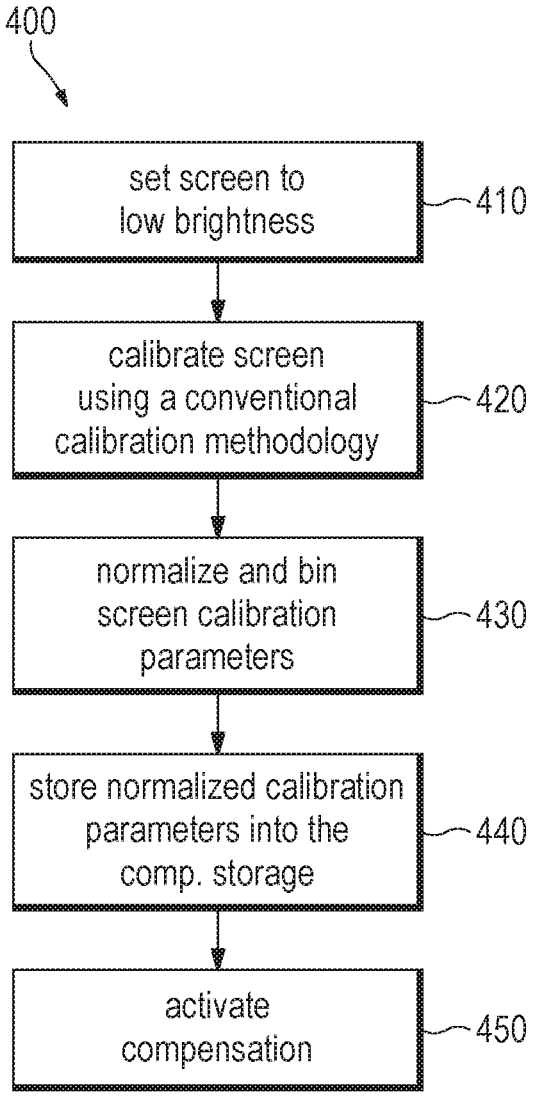
FIG. 4 is a flow diagram of a compensation procedure, according to one embodiment.

To enhance a display uniformity despite PVT differences, compensation parameters may be stored after power up and during the system configuration of the components on the PCB and used during operation to address PVT differences. For example, FIG. 4 shows an example procedure 400 for preparation of stored parameters (stored in memory 320, FIG. 3).

Initially, a display is set 410 to a low, system-wide brightness setting in preparation for calibration. It is the inventor's present belief that the brightness variations of a display at low brightness settings reflects PVT variations that manifest in output variations and inconsistencies observed between chips operating at 2-5% of their maximum brightness. These visible and measurable brightness variations are also in part a reflection of the load impedance variations and stray capacitive parasitic. Thus, 2-5% of the maximum brightness is a suitable target for this adjustment, however, other percentages of maximum brightness may be used. When the pixels on the screen contain three different colors, each color may be calibrated separately.

The screen is calibrated 420 in the conventional calibration process for high brightness calibration, using a camera, as understood by skilled persons. For example, a conventional calibration process is performed on high-brightness displays to control variations in brightness efficiencies by storing calibration parameters for a controller that adjusts a PWM vector to drive the LED. In accordance with the present disclosure, however, a similar calibration routine is used at a low brightness to determine different calibration parameters used in connection with programmable current compensator 300 of FIG. 3. As used herein, the term low brightness means a range of about 2% to about 5% of maximum brightness.

The calibrated parameters are normalized and binned 430 such that odd and out of range values are discarded and range of adjustments fall into smaller number of adjustments that is manageable for the processing and on-chip storage requirements.

The normalized values are stored 440 in the embedded memory storage of the LED driver. Low brightness calibrated parameters may be stored as a vector, as shown and described later with reference to FIG. 6.

The LIVPC compensation is activated 450 by setting the appropriate bit in, e.g., a configuration register of controller 314.

Figure 5:
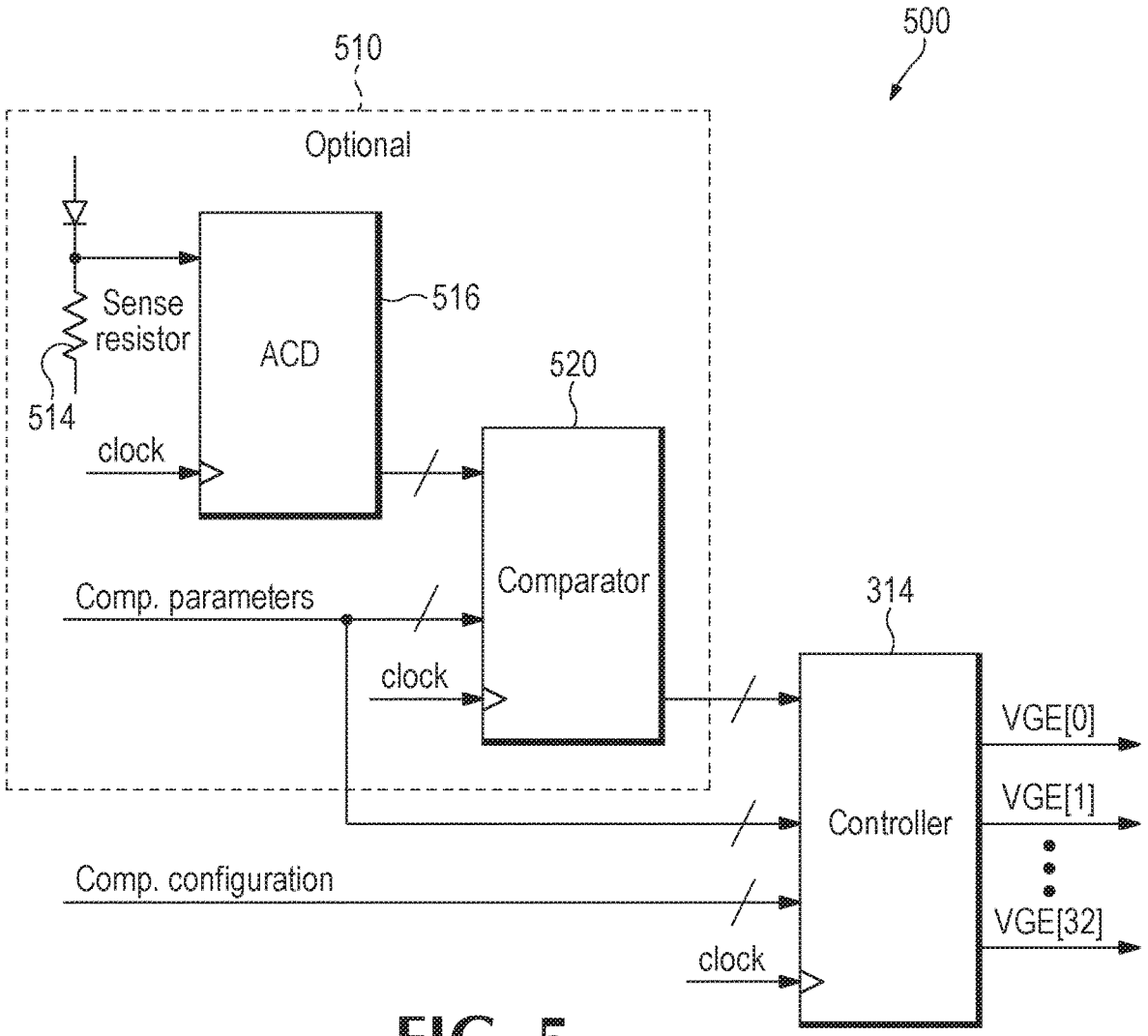
FIG. 5 is a block diagram showing components of a controller suitable for use in the compensation circuitry of FIG. 3, according to one embodiment.

FIG. 5 shows a dynamic feedback system 500 suitable for use with controller 314 to carry out the LIVPC (and PVT) compensation architecture, according to one embodiment. For example, optional dynamic feedback circuitry 510 includes a sense resistor 514 on a low-voltage side of each LED. Using an operational amplifier other components, the voltage across resistor 514 can then be taken as a sense signal and input into the analog-to-digital converter (ADC) 516. ADC 516 generates a digital output signal reflecting dynamic information about the actual current sensed for each LED in the LED display when driving the LED display at low brightness. In some embodiments, a sense signal at the anode or cathode side of each LED is accessible. In some embodiments, ADC 516 converts a sense signal into a multi-bit wide digital output signal that is used to compare in a compare block 520 against the compensation parameters extracted from storage. Depending on its configuration, comparator 520 outputs the higher (or lower) value of the two compared digital values, as explained with reference to feedback adjustment mode described later.

Figure 6:
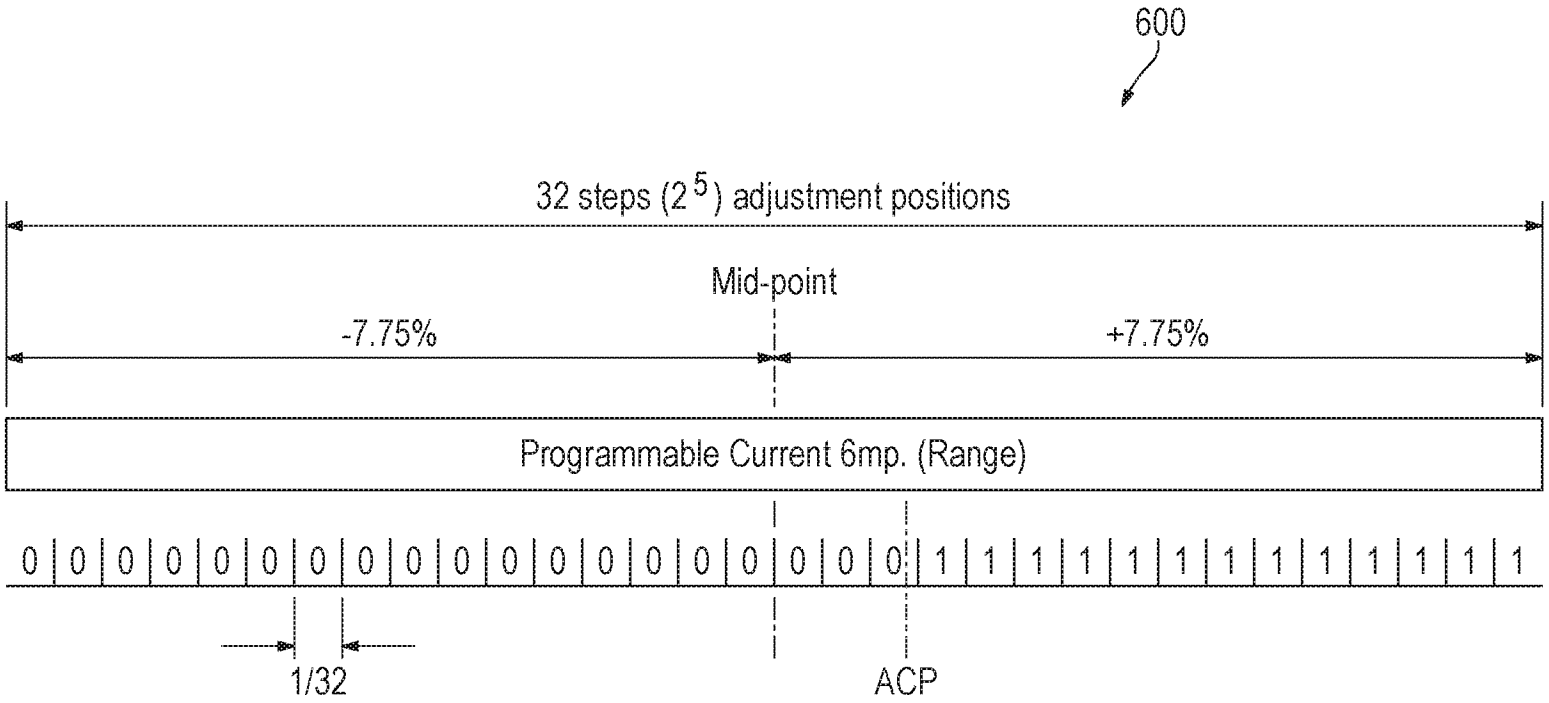
FIG. 6 is a block diagram showing how a 32-bit parameter represents switch actuation signals applied to a programmable current compensator of the compensation circuitry of FIG. 3.

FIG. 6 shows an diagram 600 of how a compensation parameter is used to control compensation current provided by a programmable current compensator (300, FIG. 3). For example, a center point of a programmable current compensator is defined based on a value of an external resistor and further programming of the ADC values. The midpoint setting may be included in LIVPC parameters stored in memory 320.

A PVT adjustment allows small adjustments of the final setting from the center point. These adjustments result in a new adjusted center point (ACP) that is further used for ± adjustments based on LIVPC (dynamic) feedback. PVT adjustment is related to the PVT variations across different LED driver devices and is a primary contributor of observable chip-to-chip variation of the constant current outputs between devices. PVT adjustment mode, therefore, provides for a relatively fine adjustment of supplemental current, e.g., by slightly adjusting a default number of switch elements are actuated in a programmable current compensator.

LIVPC adjustment is a dynamic adjustment of the ACP based on the feedback provided on stored values of the parameters for each LED (included in LIVPC parameters stored in LIVPC memory 320). These adjustment provide facilities to adjust the ACP by a small fraction, for example 1/32, to accommodate the differences in the load impedance variations and parasitic on the PCB. LIVPC adjustment may be additive to PVT adjustment. As noted previously, a channel may include 32 nodes to collective deliver the nominal current, and those nodes are coupled to the 32 parallel switching elements that suppress or enhance incremental current flowing from some or all of the corresponding nodes. The result from the 32 switching elements and 32 nodes is an adjusted amount of current made available for an LED.

If a feedback adjustment mode is selected, comparator 520 (FIG. 5) of dynamic feedback system 500 compares the monitored value of the output dynamically and compares it to a stored value and scales the difference based on the programmed value of the scale.

Skilled persons will appreciate that many changes may be made to the details of the above-described embodiments without departing from the underlying principles of the invention. For example, current controller 212 (FIG. 2) may comprise any device or circuit now known or that may be developed in the future to generate the previously described adjusted current. For example, current controller 212 may comprise devices such as comparators, amplifiers, oscillators, counters, frequency generators, ramp circuits and generators, digital logic, analog circuits, application specific integrated circuits (ASIC), microprocessors, microcontrollers, digital signal processors (DSPs), state machines, digital logic, field programmable gate arrays (FPGAs), complex logic devices (CLDs), timer integrated circuits, digital to analog converters (DACs), analog to digital converters (ADCs), and other circuitry. The terms circuit and circuitry refer to, may be part of, or include an ASIC, an electronic circuit, a processor (shared, dedicated, or group), or memory (shared, dedicated, or group) that executes one or more software or firmware programs, a combinational logic circuit, or other suitable hardware components that provide the described functionality. In some embodiments, the circuitry may be implemented in, or functions associated with the circuitry may be implemented by, one or more software or firmware modules. In some embodiments, circuitry may include logic, at least partially realized in hardware. The scope of the present invention should, therefore, be determined only by the following claims.

The invention claimed is:

1. A current controller for an output stage of light emitting diode (LED) driver circuitry defining a set of channels through which electrical current is controllably deliverable to a set of LEDs along an actuatable scanline, the current controller comprising:

a current source to establish a nominal amount of current available for each member of the set of channels, the nominal amount of current being based on a desired brightness level;

pulse width modulation (PWM) circuitry electrically coupled to the current source and configured to control durations in which adjusted amounts of current are applied to corresponding members the set of LEDs; and compensation circuitry electrically coupled to the current source and the PWM circuitry, the compensation circuitry including a set of switching elements to adjust, for each corresponding member of the set of LEDs, the nominal amount of current and thereby provide to the PWM circuitry the adjusted amounts of current based on feedback representing one or both load impedance variations and parasitic conditions (LIVPC) and process, voltage and temperature (PVT) conditions.

2. The current controller of claim 1, in which the compensation circuitry comprises a compensation parameter storage device to store, for each LED, values representing adjustment amounts by which to adjust the nominal amount of current.

3. The current controller of claim 2, in which each value of the values includes multiple bits, each one of the multiple bits indicating a state of a different member of the set of switching elements.

4. The current controller of claim 2, in which the compensation circuitry comprises a controller to generate, based on a value stored in the compensation parameter storage device, a set of digital signals corresponding to the set of switching elements.

5. The current controller of claim 2, in which the adjustment amounts are within a pre-defined range between positive and negative maximum percentages of the nominal amount of current.

6. The current controller of claim 2, in which each switching element comprises one more transistors.

7. The current controller of claim 1, in which each member of the set of switching elements is arranged in parallel with the other members of the set of switching elements.

8. The current controller of claim 7, in which each member of the set of switching elements is configured to change state based on a corresponding signal from a corresponding one of a set of digital control signals.

9. The current controller of claim 8, in which the set of digital control signals includes a first set of logic levels representing multiple incremental decreases in current and a second set of logic levels representing multiple incremental increases in current.

10. An LED display panel including the current controller of claim 1.

* * * * *